United States Patent [19]

Washington et al.

[11] 4,005,668

[45] Feb. 1, 1977

[54] MATERIAL TRANSFER METHOD AND APPARATUS

[75] Inventors: James M. Washington, Richmond; Emil A. Marx, Chester, both of Va.

[73] Assignee: Philip Morris Incorporated, New York, N.Y.

[22] Filed: June 9, 1975

[21] Appl. No.: 585,105

[52] U.S. Cl. ..... 141/67; 141/129; 222/194; 221/211

[51] Int. Cl.[2] ..... B65B 1/16; B65B 3/10

[58] Field of Search ..... 141/144, 67, 163, 169, 141/129, 130, 183; 198/82, 25; 222/264, 194, 271, 345, 272, 347, 367–369, 284, 204, 335; 93/1 C; 209/73, 111.6, 111.7, 94, 95; 214/1 BS; 221/211, 278

[56] References Cited

UNITED STATES PATENTS

| | | | |
|---|---|---|---|
| 1,867,998 | 7/1932 | Benson | 141/183 |
| 3,244,328 | 4/1966 | Brown | 222/194 |
| 3,306,323 | 2/1967 | Aronson | 141/72 |
| 3,312,151 | 4/1967 | Molins | 222/194 |
| 3,312,152 | 4/1967 | Williamson | 141/144 |
| 3,446,404 | 5/1969 | Mehta | 222/368 |

FOREIGN PATENTS OR APPLICATIONS

| | | | |
|---|---|---|---|
| 83,194 | 7/1957 | Denmark | 222/194 |

*Primary Examiner*—Robert B. Reeves
*Assistant Examiner*—H. Grant Skaggs
*Attorney, Agent, or Firm*—Watson Leavenworth Kelton & Taggart

[57] ABSTRACT

Material is collected in radially extending slots opening into the outer periphery of a first wheel intermittently rotated about a first axis to successively dispose material-containing slots at a registration location. A second wheel is rotated synchronously with the first wheel about an axis perpendicular to the first axis to successively dispose slots extending axially therein at the registration location. Material is forcibly discharged from the first wheel slots to the second wheel slots as they are maintained in stationary facing relation at the registration location.

10 Claims, 4 Drawing Figures

MATERIAL TRANSFER METHOD AND APPARATUS

FIELD OF THE INVENTION

This invention pertains generally to methods and apparatus for use in granular material transfer and more particularly to methods and apparatus for collecting granular material in predetermined quantity and transferring same for assembly of cigarette filters.

BACKGROUND OF THE INVENTION

In various cigarette filters, a pair of end filter plug members are encircled by filter wrap and therewith define a cavity for containment of a measured quantity of low-density granular material between the plug members. Typically, the flow characteristics, of the granular material are such that positive, i.e., forcible transfer thereof is required. Thus, the material is frequently not free-flowing and gravity, air pressure, mechanical force or other positive assist is employed in transfer thereof.

In granular material transfer arrangements heretofore known for use in filter cigarette manufacture, such as are shown in U.S. Pats. Nos. 3,545,345 and 3,550,508, rotative members define peripheral radially disposed slots and are cooperative with granular material hoppers to collect and transfer measured quantities of material into registry with cavities between axially spaced plug members rectilinearly advanced by a conveyor. To the extent that such rotative collector-transfer members are used in such known transfer arrangements for the filling of cavities having volume limits defined by the spacing of plural end plug members, such arrangements evidently demand extensive care in the placement of end plug members. In addition, these arrangements are considered to present a complex registration problem as between a rigid rotative member and a resilient conveyor. Furthermore, to the extent that material transfer is positively assisted in the former of these patents, the same is effected only upon dispensing and by a mechanical agency susceptible to binding where the granular material is a fine thermoplastic powder.

In another presently known arrangement, shown in U.S. Pat. No. 3,603,058, granular material is transferred to a vertically extending cavity formed by filter wrap and one end plug member therefor with the opposed end plug member being then inserted in the wrap atop the contained material. While this arrangement avoids the disadvantages above discussed by eliminating the need for careful spacing of end plug members prior to material transfer, the metering of material prior to its transfer is accomplished through a metering chamber having a cyclically displaceable closure member. Thus, the closure member defines a removable floor for the metering chamber to control transfer quantity, and mechanism is required for displacing such floor to dispense material to the filter wrap cavity. Furthermore, to the extent that this system contemplates positive material transfer, the same involves an air pressure assist operative during material dispensing only.

SUMMARY OF THE INVENTION

The present invention has as its object the provision of improved methods and apparatus for collecting and transferring predetermined quantities of granular material from storage hoppers to cavities of material receiving elements.

It is a more particular object of the invention to provide simplified method and apparatus for the collection and transfer of granular material for use in cigarette filters.

In attaining these and other objects, the invention provides a method wherein a receiving element is assembled to define an open cavity, wherein a predetermined quantity of granular material is positively collected and moved in a circular path about a first axis while the receiving element is moved in a circular path about a second axis orthogonal to the first axis and wherein positive transfer or dispensing of the collected granular material to the receiving element is effected at the singular location of intersection of the first and second circular paths, i.e., where the collected material and receiving element are in facing relation. In preferably implementing such method specifically for filter cigarette manufacture, the invention provides apparatus comprising a granular material fluidized-bed hopper having an entrance opening by which a rotative material collector wheel may enter the hopper, the collector wheel having radially extending peripherally open slots, drive means for intermittently rotating the collector wheel to successively dispose slots thereof in the hopper, a material receptor wheel defining peripherally open slots in which may be disposed such as a filter plug and wrap therefor, said drive means intermittently rotating the receptor wheel in synchronism with the collector wheel to successively dispose slots of the respective wheels in facing relation. The collector wheel is cooperative with pressurized air means such that slots thereof are selectively pressurized, i.e., when disposed in the hopper, and accordingly are positively filled with hopper contained material. A slot closure member is cooperative with the collector wheel to maintain material in slots thereof as such slots exit the hopper and travel into registration with receptor wheel slots. Pressurized air selectively expels the contents of the collector wheel slots into the receptor wheel slots.

The foregoing and other objects and features of the invention will be evident from the following detailed description of preferred practice and preferred embodiment in accordance with the invention and from the drawings wherein like reference numerals identify like parts throughout.

DESCRIPTION OF THE PREFERRED EMBODIMENT

Figure 1:
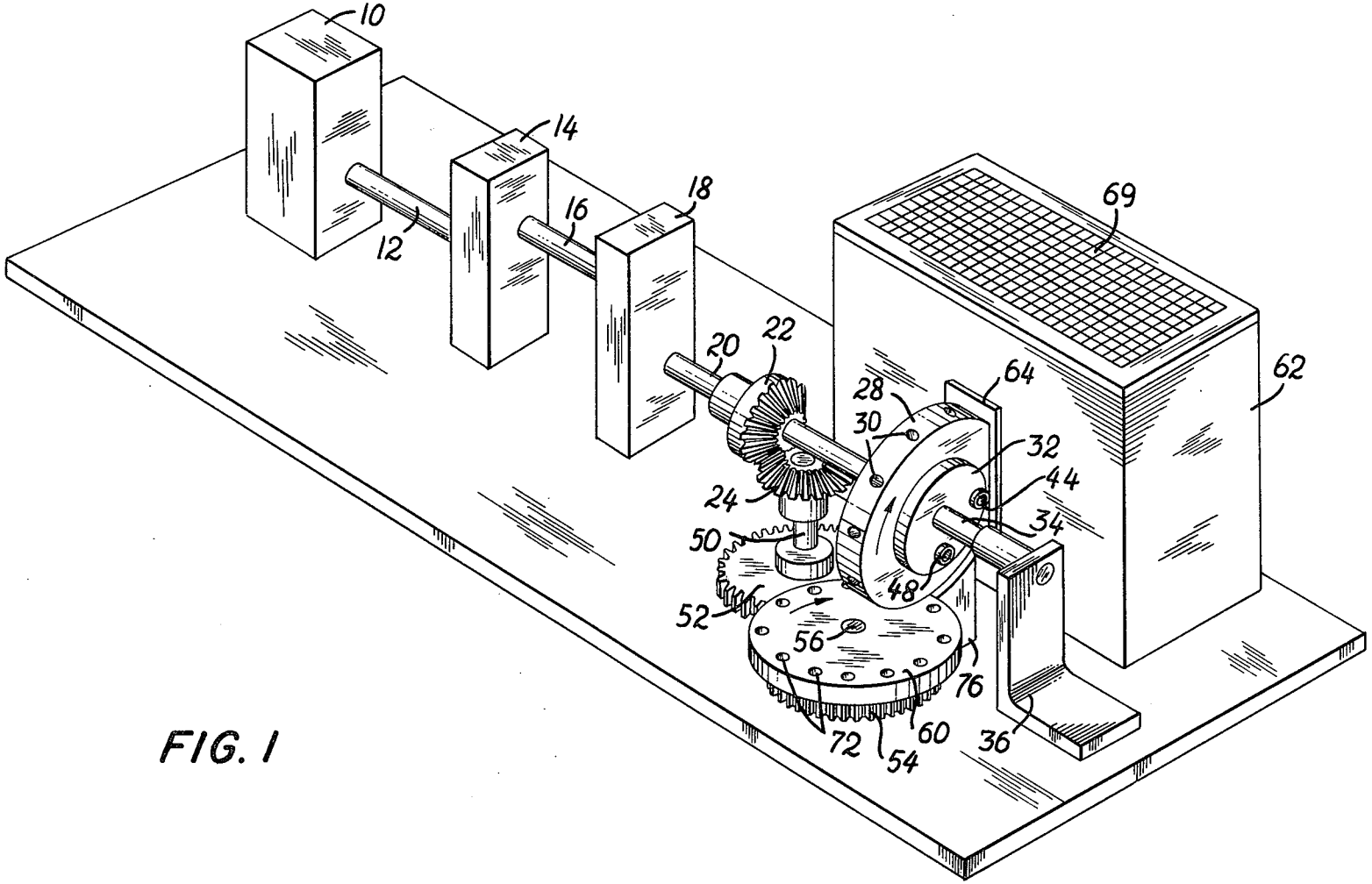
FIG. 1 is a perspective view of apparatus in accordance with the invention with air pressurization lines and exterior casings omitted in the interests of clarity.

Referring to FIG. 1, a drive assembly includes motor unit 10, motor shaft 12, Geneva escapement mechanism 14, shaft 16 and reduction gear mechanism 18, whose output shaft 20 supports miter gear 22 in engagement with miter gear 24. Shaft 20 also supports disc member 26 (FIG. 2) which is keyed to and supports collector wheel 28 for rotation.

With motor unit 10 energized, shaft 12 rotates at constant speed. Mechanism 14 is operatively responsive to such constant rotational speed input cyclically to rotate its output shaft 16 unidirectionally through a ninety degree angle and then interrupt shaft 16 rotation for a preselected time period. Mechanism 18 is a three-to-one reduction gear mechanism whereby its output shaft converts such intermittent ninety degree rotation of shaft 16 into intermittent thirty degree rotation of shaft 20.

Collector wheel 28 includes radial slots 30 (FIG. 3) each having one end open at wheel outer periphery or circumference 28*a* and an opposite end open at wheel inner periphery 28*b*. Each slot supports, in slot wall shoulders or the like, a porous (air-permeable) disc 31, preferably comprised of sintered steel of 17 to 37 micron diameter, intended not to pass therethrough particles of 50 micron diameter. A cavity for receipt of granular material is thereby defined for each slot, the cavity volume equalling that part of the slot volume extending radially outwardly of disc 31.

Figure 2:
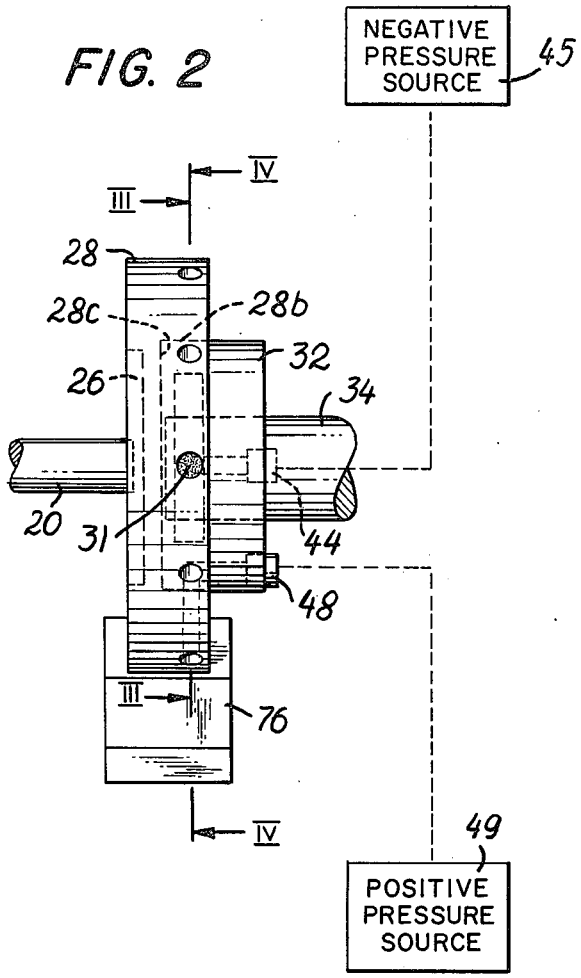
FIG. 2 is a front elevational view of collector wheel 28 of FIG. 1 with receptor wheel 60 removed from its FIG. 1 position.
Figure 4:
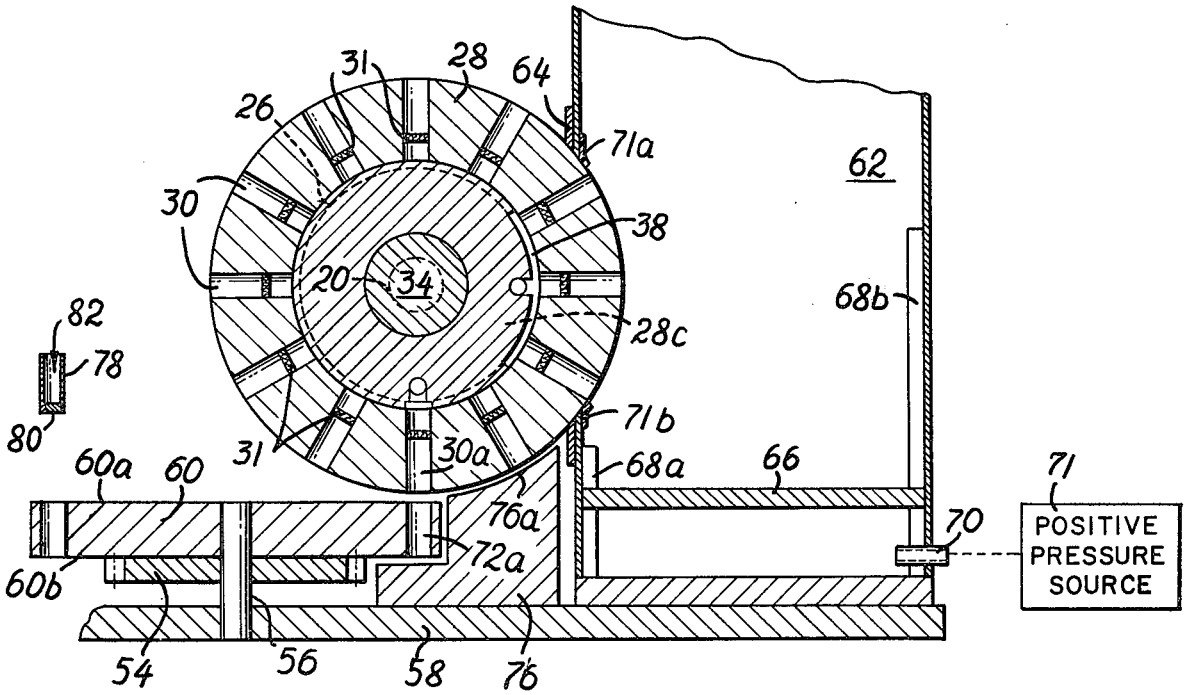
FIG. 4 is a side elevational view as seen from plane IV—IV of FIG. 2.

As is shown in FIGS. 2 and 4, the rightward portion of collector wheel 28 includes a central opening 28*c* whose outer boundary is defined by wheel inner periphery 28*b*. The diameter of opening 28*c* is slightly larger than the diameter of hub member 32, insertable in opening 28*c*, whereby the collector wheel may rotate freely relative to the hub member while closely encircling same for purposes below discussed. Hub member 32 is itself supported by shaft 34 seated in support flange 36.

Figure 3:
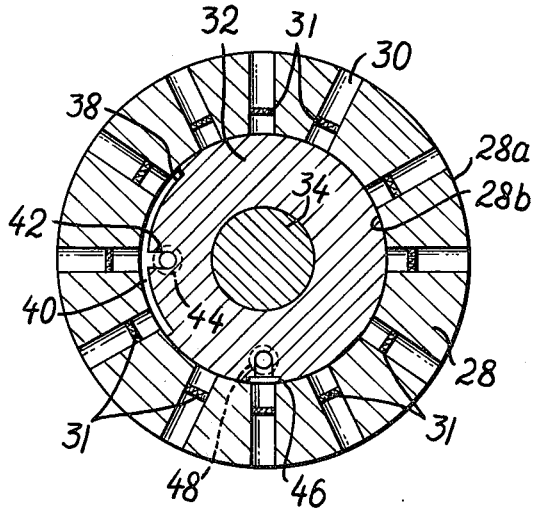
FIG. 3 is a side sectional view as seen from plane III—III of FIG. 2.

Referring to FIG. 3, hub member 32 includes a recessed peripheral portion 38 extending over approximately a ninety degree interval and defining with collector wheel inner periphery 28*b* a duct 40. Duct 40 communicates centrally with conduit 52, the latter extending radially into hub member 32 and then axially outwardly to fitting 44 which is connected to negative pressure source 45. Hub member 32 includes a further conduit 46 opening into the periphery of hub member 32, extending radially therefrom and then axially outwardly to fitting 48 which is connected to positive pressure source 49.

Referring again to FIG. 1, miter gear 24 is secured to shaft 50 which is in turn keyed to spur gear 52 in engagement with spur gear 54. Shaft 56 (FIG. 4) of spur gear 54 is supported for rotation in base 58. Receptor wheel 60 is keyed to shaft 56 for rotation therewith. Gears 22 and 24 being identical and gears 52 and 54 being identical, receptor wheel 60 is rotated synchronously intermittently with collector wheel 28.

Material hopper 62 (FIGS. 1 and 4) is upstanding on base 58 and includes an entrance opening in the form of a vertical slot in hopper front plate 64. The respective dimensions of collector wheel 28 and hopper plate 64, and the relative positioning of shaft 20 and hopper 64 on base 58, are such that three collector wheel slots are disposed with their peripheral (first ends within hopper 62. Hopper 62 includes an air-permeable material support plate 66 (FIG. 4) vertically movable in tracks 68a and 68b and an air-permeable top closure member 69. Plate 66 is constructed as in the case of discs 31 above discussed. Member 69 may be a gauze or fibrous batt air filter. With inlet 70 connected to a positive pressure source 71, air flow is directed through plate 66, through the material thereabove and out of top closure member 69, serving to fluidize the hopper contents.

Hopper 62 further includes sealing strips 71a and 71b comprised of thin flexible resilient sheet material, such as felt, serving both to seal the edges of the hopper entrance opening and to wipe excess material from the surface of collector wheel 28.

Receptor wheel 60 includes a plurality of axially extending slots 72 (FIGS. 1 and 4) having an end opening into upper side surface 60*a* of the receptor wheel and an opposite end opening into lower side surface 60*b*. In the specific embodiment under discussion, such receptor wheel slots are of like number $n$ (12 ) to the number of collector wheel slots 30 with FIG. 4 illustrating a registration disposition of the collector and receptor wheels wherein collector wheel slot 30*a* is in stationary facing relation to receptor wheel slot 72*a*. With gears 22 and 24 and gears 52 and 54 having identical structure above discussed, thirty degree ($360°/n$) intermittent rotation of the wheels will evidently place successive pairs of slots in like stationary facing relation.

In use of the apparatus described to this juncture, as collector wheel 28 is rotated, slots 30 are displaced such that the radially interior (opposite) ends thereof are placed in communication with duct 40 (FIG. 3). With constant negative pressurization of fitting 44, granular material is forcibly drawn from hopper 62 into the slots as they so communicate with duct 40. As the collector wheel is rotated counterclockwise from its FIG. 3 position, material-containing slots thereof are displaced downwardly outwardly of the hopper entrance opening and the contained granular material is retained in place in the slots by action of shoe 76 whose arcuate surface 76*a* is of like curvature to that of the collector wheel periphery and is quite closely disposed relative thereto. As each material-containing slot is further displaced beyond the surface of shoe 76, it is situated both in the aforesaid registration position with a receptor wheel slot and in communication with duct 46. The latter is constantly positively pressurized by air pressure applied to fitting 48 whereby the contents of the collector wheel slot at the registration station are forcibly transferred to the facing receptor wheel slot. The receptor wheel slots may alternatively be negatively pressurized by a vacuum fitting at the registration station juxtaposed with lower side surface 60*b* of the receptor wheel. The invention further contemplates joint use of such positive and negative pressurization apparatus.

In use of receptor wheel 60 for the particular application of cigarette filter manufacture, a sleeve 78 of filter wrap is formed with filter plug 80 seated at one end of the sleeve. Such assembly is placed in each receptor wheel slot, is frictionally held in place, and defines a cavity 82 for receipt of the granular material. Such cavity may then be closed by a further filter plug.

While the invention has been disclosed in an embodiment involving a pair of cooperative wheel members having equal numbers of slots, it is to be appreciated that the same can be modified to encompass plural collector wheels for effecting successive feed of dissimilar materials, collected by each wheel from a separate hopper, to a single receptor wheel. In addition, the invention contemplates dissimilar numbers of slots on the respective collector and receptor wheels and arrangements wherein adjacent sets of slots may be employed both on the collector wheel and on the receptor wheel. As will also be appreciated, collector wheel slots and receptor wheel slots may extend from their registrable ends with angulation other than the preferred respectively radial and axial angulation. These and other modifications made evident to those skilled in the art are evidently within the scope of the invention. Thus, the particularly disclosed embodiment and practice are intended in an illustrative and not in a limiting sense. The true spirit and scope of the invention is set forth in the following claims.

What is claimed is:

1. Apparatus for use in making cigarette filters containing granular material comprising:

a. hopper means for containing said material;

b. a material collector wheel supported for rotation about a first axis and having a slot with a first end open at the circumference of said collector wheel and an opposite end, said collector wheel supporting an air permeable member in said slot thereof;

c. a receptor wheel supported for rotation about a second axis perpendicular to said first axis and having a slot with an end open at a side surface of said receptor wheel, said receptor wheel supporting in said slot thereof a filter assembly defining a cavity having an opening facing said side surface;

d. drive means for rotating said collector wheel about said first axis to move said collector wheel slot first end interiorly of said hopper means and then exteriorly thereof to a registration position and for rotating said receptor wheel about said second axis to move said receptor wheel slot end into facing relation with said collector wheel slot first end at said registration position; and e. air pressurization means for negatively pressurizing said collector wheel slot opposite end selectively upon disposition of said collector wheel slot first end interiorly of said hopper means, whereby material is transferred into the extent of said collector wheel slot extending outwardly of said air permeable member thereof, and for providing selective differential pressurization axially of said collector wheel and receptor wheel slots at said registration position, thereby discharging said material from said collector wheel slot into said filter assembly cavity

2. The apparatus claimed in claim 1 wherein said air pressurization means positively pressurizes said collector wheel slot opposite end selectively upon disposition of said collector wheel slot first end at said registration position for effecting said material discharging.

3. The apparatus claimed in claim 1 wherein said collector wheel defines a cylindrical periphery radially interiorly of said collector wheel circumference, said collector wheel slot opposite end opening into said periphery, said air pressurization means comprising a hub member non-rotatively supported with respect to said collector wheel and disposed interiorly of said collector wheel periphery and defining therewith a duct for said negative pressurization of said collector wheel slot opposite end, said duct being of extent providing for negatively pressurizing said collector wheel slot when said first end thereof is disposed in said hopper means and for discontinuing said slot negative pressurization upon movement of said slot outwardly of said hopper means.

4. The apparatus claimed in claim 3 wherein said hub member includes a further duct fixedly disposed at said registration position and communicating with said collector wheel slot opposite end for positively pressurizing the same for effecting said material discharging.

5. The apparatus claimed in claim 1 further including means supporting an arcuate surface in facing relation to said collector wheel circumference for closing said collector wheel slot first end upon movement thereof exteriorly of said hopper means to said registration position.

6. The apparatus claimed in claim 1 wherein said hopper means include an entrance opening for receiving said collector wheel, an air-permeable base supporting said material in engagement with said collector wheel, an air-permeable closure member and means for maintaining a flow of air into said base, through said material thereon and thence through said closure member.

7. The apparatus claimed in claim 1 wherein said collector wheel slot is provided in a plurality of $n$ such slots, the first ends of said collector wheel slots being uniformly spaced in said collector wheel circumference and wherein said receptor wheel slot is provided in an identical plurality of $n$ such slots, the ends of said receptor wheel slots being uniformly angularly spaced in said receptor wheel side surface, said drive means intermittently rotating said collector wheel and said receptor wheel through angular increments of $360°/n$.

8. The apparatus claimed in claim 1 wherein said collector wheel slots extend radially interiorly from said collector wheel circumference.

9. The apparatus claimed in claim 1 wherein said receptor wheel slots extend parallel to said second axis.

10. The apparatus claimed in claim 1 wherein said collector wheel slots extend radially interiorly from said collector wheel circumference and wherein said receptor wheel slots extend parallel to said second axis.

* * * * *